US006565289B2

(12) United States Patent
Khamis

(10) Patent No.: US 6,565,289 B2
(45) Date of Patent: May 20, 2003

(54) SELF-CONNECTING, REINFORCED RETAINING WALL AND MASONRY UNITS THEREFOR

(75) Inventor: Suheil Rashid Khamis, Nazareth Ilit (IL)

(73) Assignee: Permawall Systems, Inc., Wilmington, DE (US)

( * ) Notice: Subject to any disclaimer, the term of this patent is extended or adjusted under 35 U.S.C. 154(b) by 0 days.

(21) Appl. No.: 10/115,636

(22) Filed: Apr. 4, 2002

(65) Prior Publication Data

US 2002/0119015 A1 Aug. 29, 2002

Related U.S. Application Data

(62) Division of application No. 09/573,398, filed on May 18, 2000, now Pat. No. 6,416,260.

(51) Int. Cl.[7] ..... E02D 5/00

(52) U.S. Cl. ..... 405/286; 405/284; 405/262; 52/606

(58) Field of Search ..... 405/284, 286, 405/262; 52/606, 596; 249/188; 404/45, 70; D25/152, 157

(56) References Cited

U.S. PATENT DOCUMENTS 4,909,010 A * 3/1990 Gravier ..... 52/609
6,089,792 A * 7/2000 Khamis ..... 405/262

* cited by examiner

*Primary Examiner*—Robert E. Pezzuto
*Assistant Examiner*—Alexandra K. Pechhold
(74) *Attorney, Agent, or Firm*—E. Alan Uebler, PA

(57) ABSTRACT

A self-connecting, reinforced retaining wall is provided comprised of precast, stacked concrete block masonry units stabilized with reinforcing members which extend from the masonry units at selected intervals into the adjacent reinforced soil to form a mechanically stabilized earthen wall construction. The reinforcement members are generally in the form of horizontally oriented "U"-shaped members which extend from within the adjacent soil bank, to and through voids of the masonry units, thereby providing self-connecting means thereat, and thence returning into the soil bank, forming a stabilized, retained and reinforced soil embankment. Suitable reinforcements may include metallic grids, geotextile and geogrid sheets, and other similar reinforcement means. Concrete masonry units especially adapted for use in the aforesaid self-connecting soil reinforced retaining walls are also provided.

2 Claims, 4 Drawing Sheets

SELF-CONNECTING, REINFORCED RETAINING WALL AND MASONRY UNITS THEREFOR

This application is a division of prior copending application Ser. No. 09/573,398, filed May 18, 2000 now U.S. Pat. No. 6,416,260.

BACKGROUND OF THE INVENTION

Many types, shapes and designs of retaining walls are used in architectural and site development applications. In several common constructions, the wall facings, which must withstand high lateral forces exerted by the retained fill, reinforcement is provided by grid-like or sheet-like materials which extend in layers within the backfill soil behind the wall face. These layered reinforcements are connected to elements forming the facing wall, typically concrete blocks, by suitable connectors. A number of recent patents have issued disclosing various forms of connectors and connecting means for such walls. See, for example, U.S. Pat. No. 5,975,810, U.S. Pat. No. 5,540,525, and the references cited therein for specific descriptions of several such connection means.

My recently issued U.S. Pat. No. 5,050,749, issued Apr. 19, 2000, and my soon-to-be issued U.S. patent application Ser. No. 08/994,327 describe a particular form of a mechanically stabilized earthen wall construction and a particularly suitable masonry unit suitable for use in such constructions. Both of those references, accordingly, are incorporated herein by reference thereto, as are all of the references which were of record in the prosecution of those patents, which references are readily available in the records of the U.S. Patent and Trademark Office.

Of the four basic classes of retaining walls, i.e., gravity, cantilever, anchored and mechanically stabilized backfill, the present invention relates solely to the latter. By way of background, gravity walls depend upon the weight of the wall itself to prevent overturning and sliding. A cantilever wall may be reinforced in order to resist applied moments and shear forces. Anchored walls resist lateral forces through the use of tieback anchors or soil nails. In contrast, mechanically stabilized backfilled walls include mechanical reinforcement members extending backwardly and generally horizontally from the front face of the wall into the retained embankment soil to form a coherent mass. Enhanced reinforcement is attained, at least in part, by increased frictional shear resistance and passive resistance which occurs along common interfaces between the soil in the embankment and the reinforcing members. Conventional reinforcing members generally are in the form of strips, grids, sheets, rods or fibers which increase the resistance of the soil to tensile forces far beyond those which the soil alone is able to withstand.

Both metallic (steel) and nonmetallic, e.g., glass fiber and polymeric (geotextile, geogrid), materials have been used for reinforcement purposes. By definition herein, metallic reinforcements such as steel and steel mesh and glass fiber will be termed "inextensible" or "rigid" materials and nonmetallics such as geogrids and geotextiles will be termed "extensible" or "flexible" materials, owing to their disparate elastic moduli and creep resistance properties, and to be more or less consistent with similar usage in prior literature in this art.

Prior mechanically stabilized backfilled wall systems generally comprise four essential components: (1) the facing elements; (2) the connection or connectors connecting the facing elements and the reinforcing elements; (3) the reinforcing elements themselves; and (4) the reinforced soil, all of which comprise the reinforced retaining wall system. The facing elements may be precast, modular concrete blocks. The front face of such blocks may be covered with a decorative material, such as slate or the like, which is generally employed solely for aesthetic purposes.

Use of strip or rod or sheet reinforcements creates a mechanically stabilized backfill by placing such reinforcements in horizontal planes between successive lifts of soil backfill. Grid reinforcement systems are formed by placing metallic or polymeric grid elements in horizontal planes vertically spaced apart in the soil backfill.

Reinforced retaining walls have many uses, particularly in the construction of transportation facilities wherein these constructions are used to retain embankments and as roadway supports. Further uses of such walls include sea walls, bridge abutments and other, similar configurations.

Several prior retaining wall systems are known. For example, U.S. Pat. No. 4,961,673 discloses a retaining wall construction comprised of a first portion which includes compacted granular fill defining a three dimensional earthenwork bulk form which includes a plurality of tensile members dispersed within the bulk form to enhance the coherency of the mass. The tensile members project from the bulk form and are connected to a second component portion which defines a face construction. The face construction is comprised of a plurality of facing panels connected to tensile members with concrete layers enveloping the connection between the facing panels and the tensile members. See also the references cited in the '673 patent, which disclose many and varied embodiments of reinforced retaining wall systems. A recently issued U.S. patent, U.S. Pat. No. 5,586,841, discloses a modular block wall which includes dry cast, unreinforced modular wall blocks with anchor type, frictional type or composite type soil stabilizing elements recessed therein and attached thereto by vertical rods which also connect the blocks together. The soil stabilizing elements are positioned in counterbores or slots in the blocks and project into the compacted soil behind the courses of modular wall blocks. The many and varied connector means disclosed in that patent, all of which are wholly unrelated to the system of the present invention, provide indications of the current state of this art in the retaining wall field. See also, U.S. Pat. No. 5,540,525, cited hereinabove, for recent teachings regarding connector means.

Mechanically stabilized backfill systems have many advantages over other types of systems. Those advantages include relatively easy and rapid construction, stability of the wall during construction, regardless of height or length, relative flexibility with respect to lateral deformation and differential vertical settlements, and, importantly, economic advantages. Disadvantages may include corrosion of metallic reinforcements (which may be delayed by galvanizing or by the use of resin coatings), excessive creep in the case of polymeric reinforcements and the depth and expanse of excavation needed in certain instances.

In contrast to the prior mechanically stabilized earthen wall constructions known and described hereinabove, which include face wall elements and reinforcements extending from the face wall into the backfill soil connected to the facing wall by various connector means, the reinforced wall system according to the present system is self-connecting, wherein the reinforcements and the facing wall together form a unitary, 3-dimensional stabilized construction having no separate and distinct connectors for connecting the wall elements and the reinforcing means.

Modular units of the invention may be constructed from a lower foundation level up to a certain designated height employing reinforced backfill, above which height the wall can be constructed as a conventional gravity wall, thus allowing increased construction flexibility, for example permitting unrestricted excavation of the retained soil near the crest of the wall to install utilities, etc.

The self-connecting system of the invention imposes only compressive stresses in the facing blocks. Concrete is very strong under compression and, as a result, this self-connecting system has substantially no weak links. The front faces of the blocks serve mainly as a facade rendering a desired aesthetic appearance. It also provides protection for the reinforcements such as from UV radiation, vandalism and fire (for polymeric reinforcements) and from fluctuating moisture that causes corrosion of metallic reinforcements.

The wall systems according to the invention comprising the reinforcement members and the facing blocks are massive and exceedingly strong, allowing the use of very high strength reinforcements and enabling stable wall constructions extending vertically to extreme heights, e.g., 20 meters or more. Both rigid walls, allowing for small horizontal displacement of the retained soil, and flexible walls, allowing for appreciable horizontal wall displacements, are possible, providing flexibility in design and allowing for versatility in design options, all while enabling the design of economically attractive high and/or low walls, optionally having curved facades and corners, and all possessing aesthetically pleasing appearances.

The objects, advantages and specific features of the invention are set forth in detail in the detailed description hereinbelow.

SUMMARY OF THE INVENTION

A reinforced retaining wall construction for an earthenwork bulk form is provided. This construction includes a plurality of precast concrete block facing elements stacked one on top of another and in side by side relationship in generally horizontal rows extending vertically upwardly from a first row resting upon a foundation plane adjacent the bulk form. Each of the block facing elements has void spaces or openings extending vertically therethrough. The blocks are stacked such that openings in the blocks in one row coincide with openings in the blocks in rows vertically adjacent the one row, and so on, upwardly from the first row to a top row. Reinforcement means are provided, generally in the form of sheets, grids, and the like oriented in generally horizontal planes and extending generally horizontally from selected block facing elements, between selected rows of the block facing elements and backwardly into the earthenwork bulk form to a considerable distance therein. Each reinforcement means extends from a remote location rearwardly of the stacked block facing elements to a selected block and is threaded through a void in the selected block, thence returning rearwardly to the remote location and in adjacent proximity thereto, thereby providing self-connecting means securing the reinforcement means to the stacked facing blocks and providing a mechanically stabilized, retained and reinforced, earthen wall construction.

The reinforcement means may include geotextile, geogrid, metallic, or other, similar, reinforcement means. A combination of such reinforcement means may be employed. The front faces of a selected number of the facing elements, including all, may be covered by a decorative covering material such as slate. Optionally, spacers may be provided to impart added overall flexibility to the construction and provide means for excess water runoff.

Also provided is a modular block masonry unit, having outside dimensions generally in the form of a parallelepiped, the masonry unit having six faces, including a front face and associated front wall of finite thickness, a top face, a bottom face, a rear face and associated rear wall of finite thickness, and two opposing side faces and side walls of finite thickness. This masonry unit also has a center partition wall generally centrally oriented parallel to and between the two side walls and extending between the top and bottom faces. The masonry unit has voids extending within the unit and through the unit from the top face to the bottom face, each void being bounded by one side wall and the center partition wall. The rear wall has indents therein adjacent both the top face and the bottom face, four indents in all, the indents extending within the rear wall each substantially from its associated side wall to the partition wall. Each indent has a depth sufficient to accept within it a reinforcement member threaded from a remote, rearward location, to its corresponding masonry unit and through a void in the unit, and thence rearwardly, back to approximately the rearward location. The reinforcement member is thus engaged by and within these indents, thereby providing a unitary, self-connecting masonry unit and reinforcing member.

The masonry unit may have side walls and a central partition wall having conventional tongue-and-groove configuration, to thereby facilitate vertical stacking and interlocking of a plurality of these masonry units.

Voids in blocks may optionally be filled with sand, gravel, concrete, etc., to increase shear resistance between stacked blocks or to increase weight and stability of the facing.

BRIEF DESCRIPTION OF THE DRAWINGS

Reference is directed to the accompanying drawings, wherein.

DETAILED DESCRIPTION OF THE INVENTION AND PREFERRED EMBODIMENTS WITH REFERENCE TO THE DRAWINGS

A self-connecting, reinforced retaining wall is provided comprised of precast, stacked concrete block masonry units stabilized with reinforcing members which extend from the masonry units at selected intervals into the adjacent reinforced soil to form a mechanically stabilized earthen wall construction. The reinforcement members are generally in the form of horizontally oriented "U"-shaped members which extend from within the adjacent soil bank, to and through voids of the masonry units, thereby providing self-connecting means thereat, and thence returning into the soil bank, forming a stabilized, retained and reinforced soil embankment. The reinforcements may include metallic grids, geotextile and geogrid sheets, and other similar tensile reinforcement means. Concrete masonry units especially adapted for use in the aforesaid self-connecting soil reinforced retaining walls are also provided.

Figure 1:
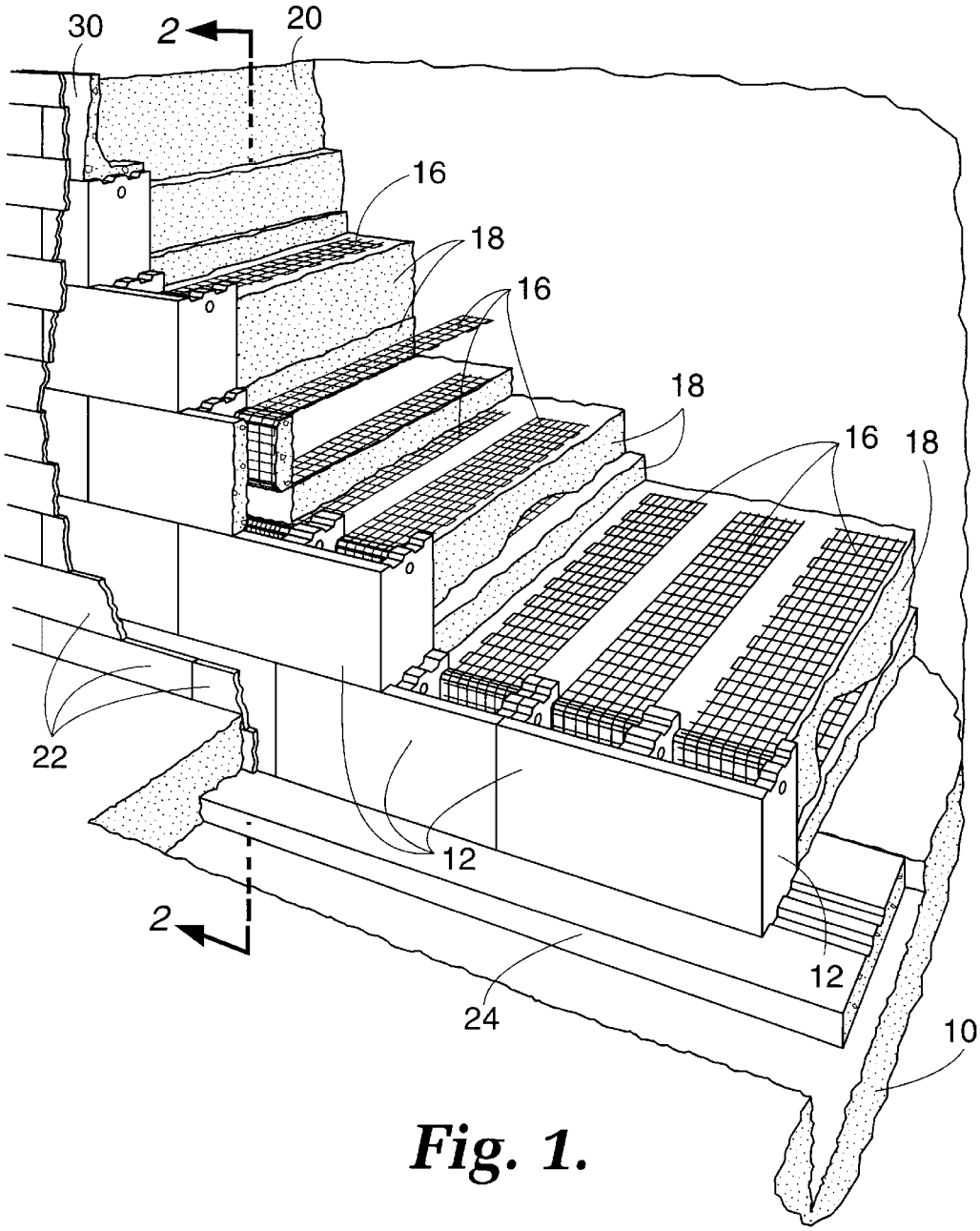
FIG. 1 is an isometric perspective view, having portions thereof partially cut away, of one embodiment of a reinforced retaining wall system according to the invention, forming a mechanically stabilized earthen wall construction.

A detailed description of the stabilized earthen wall construction of the invention and the preferred embodiments thereof is best provided with reference to the accompanying drawings wherein FIG. 1 is an overall isometric perspective view of one embodiment, with portions cut away for illustrative purposes. Therein is shown a natural (or. manmade) soil embankment 10, partially excavated, and concrete leveling pad or footer 24 having been laid using conventional techniques. Dry, precast modular concrete block facing elements 12 are stacked in rows, as shown, having staggered, overlapping orientation to one another row-to-row, and engaging each other in a conventional tongue-in-groove fashion, as shown and described in more detail below. Generally horizontally oriented grids 16 act as reinforcement members and extend between successive lifts of soil 18 and between rows of blocks 12 and extend from a remote location behind the wall of facing blocks to the blocks 12, whereat the reinforcement members are threaded through the voids in their respective blocks and thence extend backwardly again into the soil 18, to thereby provide reinforcement means to mechanically stabilize the soil by providing additional shear by frictional and passive resistance forces reacting against the outwardly directed pressure forces generated in the soil being retained. The reinforcement members 16 are accepted by and engaged within indents in blocks 12, not shown in FIG. 1 but described below, and extend backwardly therefrom. The tongue and groove configuration of the block walls facilitate perfect alignment between the stacked blocks.

The reinforcing elements 16 are depicted schematically as grids, and these may be polymeric or steel. Suitable types of known grids may be employed such as geogrids and geotextiles, and sheeting materials suitable for these applications such as geotextile sheets may also be employed.

As construction of the wall proceeds from the leveling pad 24 upwardly, fill soil 18 is replaced as necessary.

For completeness, the top row of facing blocks 30 is shown composed of cantilevered, gravity supported L-shaped blocks 30, filled by backfill 20 as shown, and, for aesthetic purposes, a covering material such as slate panels 22 may be adhered, usually with mortar, to the front face of the wall. Steel reinforcements may be employed when and where needed.

Figure 2:
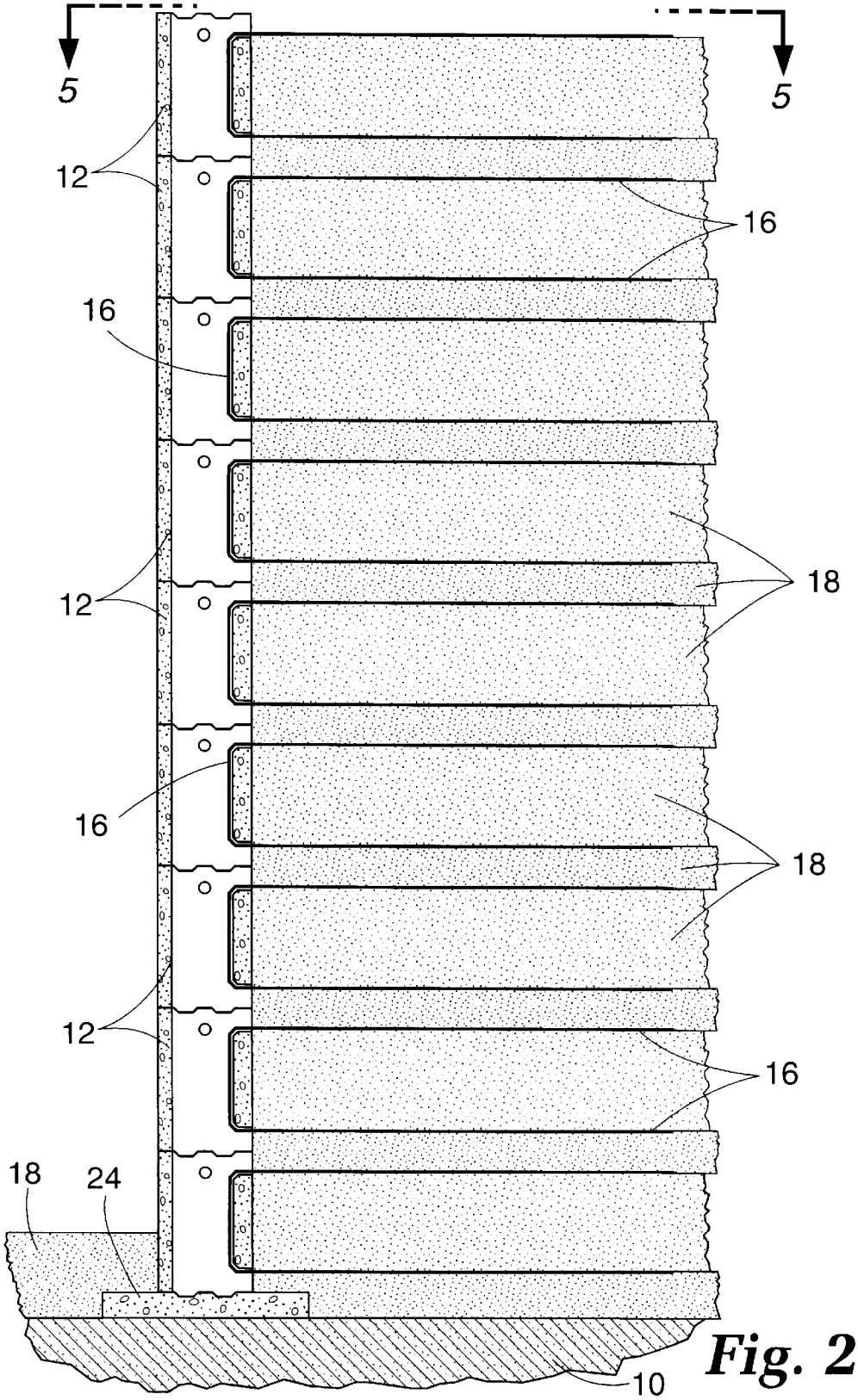
FIG. 2 is a cross-sectional side elevation of the wall construction taken substantially along line 2—2 of FIG. 1.

FIG. 2 is a cross-sectional side elevation of the wall construction depicted in FIG. 1. The construction, proceeding upwardly from the unexcavated natural soil 10, includes optional concrete foundation 24 on which are stacked rows of precast concrete blocks 12. Extending from a remote location rearwardly of the blocks 12 (the far right side in the drawing), generally horizontally and within the soil 18 behind the blockwork, the reinforcement members 16 extend a sufficient distance into stable soil behind the blockwork, depending on design specifications. The reinforcement members 16 each extend forwardly toward the blocks 12 and individual reinforcement members 16 pass under the rear wall of their respective blocks 12, upwardly through a void in block 12 and then over the rear wall of block 12 and return backwardly toward the location of origin of the individual reinforcement 16. Each individual reinforcement is seen in FIG. 2 to thus approximate a horizontally oriented "U"-shaped member. Where sheet or grid reinforcements are used, each is pre-cut to the appropriate width to enable threading through the voids of the individual blocks 12. Added transverse strength may optionally be achieved by filling vertically adjacent void spaces in blocks 12 at specified lateral wall locations to form rigid, vertical soldier beam reinforcement members for the retaining wall extending, again optionally, from its foundation to its very top section.

The top row of reinforced blocks 12 (shown in FIG. 1 but omitted in FIG. 2) supports the top row of facing blocks 30, all filled with backfill 20 and, as shown, being gravity supported. Covering panels 22 are affixed to the front faces of blocks 12 and 30.

Figure 3:
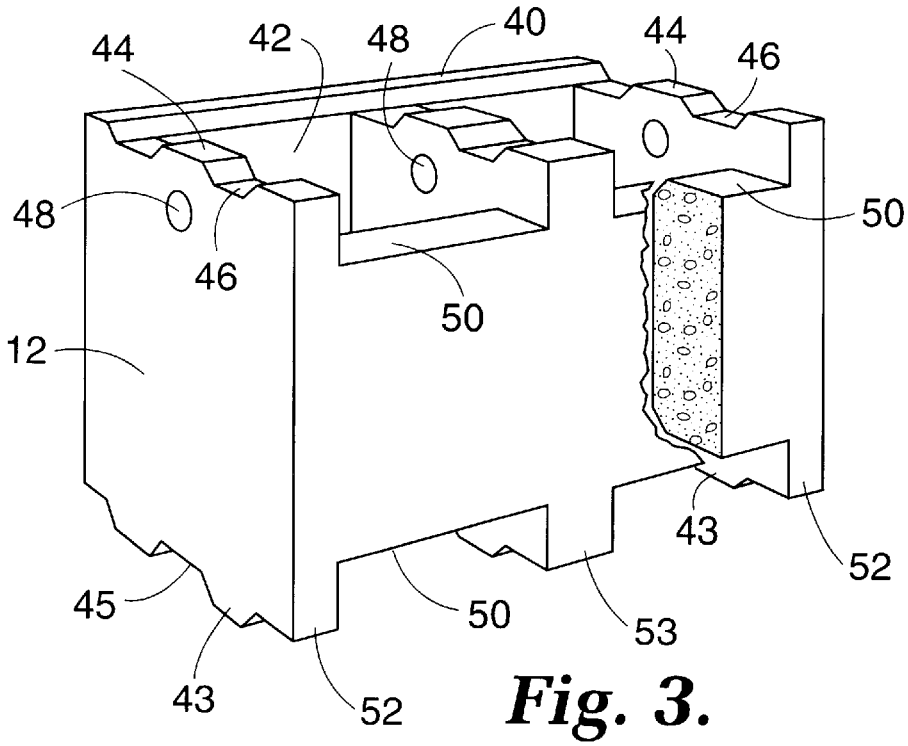
FIG. 3 is a perspective view of a preferred precast, concrete block facing element, partially broken away, suitable for use in the retaining wall system according to the invention.

FIG. 3 shows a perspective view, partly broken away, of a typical block 12 according to the present invention and useful in constructing the wall of the invention. Therein is shown the block 12 having vertical through-openings or voids 42 therein, and having conventional tongue 44 and groove 46 construction to enable such blocks to fit mechanically and snugly together, row upon row, to thereby prevent any shifting of blocks with respect to each other and to maintain alignment. Openings 48 permit passages for utility lines and the like to pass through. Openings 48 also permit grasping and lifting of the blocks by a crane or other means at the construction site to facilitate block placement and wall construction at the site. While block dimensions are not critical, preferred sizes are described below in connection with describing the method of construction of the retaining wall of the invention.

As depicted in FIG. 3, each block 12 has a front and back wall and two side walls 52, with a central partition wall 53 oriented parallel to and between the side walls 52. Block 12 has voids 42 extending vertically through it from its bottom face to its top face, and each void is bounded by the front and back walls, one side wall, and the center partition wall. The rear wall, shown partly broken away in FIG. 3, has indents 50 therein adjacent both the top face and bottom face of block 12 as shown. These indents accommodate the reinforcement members and allow them to be threaded through the voids 42 of each block 12, and to be held in place at each block/reinforcement in recessed fashion within the indents 50, such that no reinforcement encroaches upon or disturbs the snug fit of blocks 12, row-to-row. For any given construction, the reinforcements 16 may be pre-cut widthwise or cut in the field so as to fit within the indents 50 in blocks 12 being used at that particular site.

Figure 4:
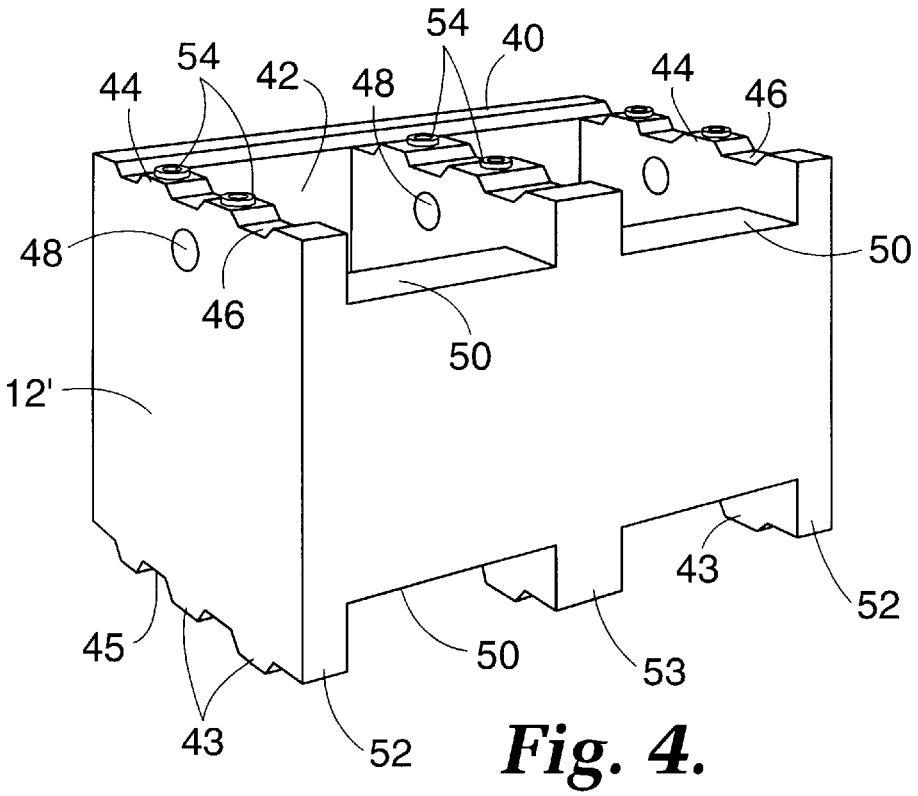
FIG. 4 is a perspective view of an alternate, also preferred, precast concrete block facing element suitable for use in the retaining wall system according to the invention.

FIG. 4 is a perspective view of an alternate embodiment of a masonry unit 12' according to the invention. Therein, the block 12' is as shown in FIG. 3 but with an alternative tongue-and-groove wall configuration, which is preferred for some constructions and is selected according to specifications. Shown in FIG. 4 are spacers 54, which may be of a foam such as styrofoam or other resilient material, such as neoprene, which may be employed to impart added cushioning flexibility to the overall construction, a particularly critical consideration at locations where the construction site is earthquake prone or where large differential settlements of the foundation soil is anticipated.

Figure 5:
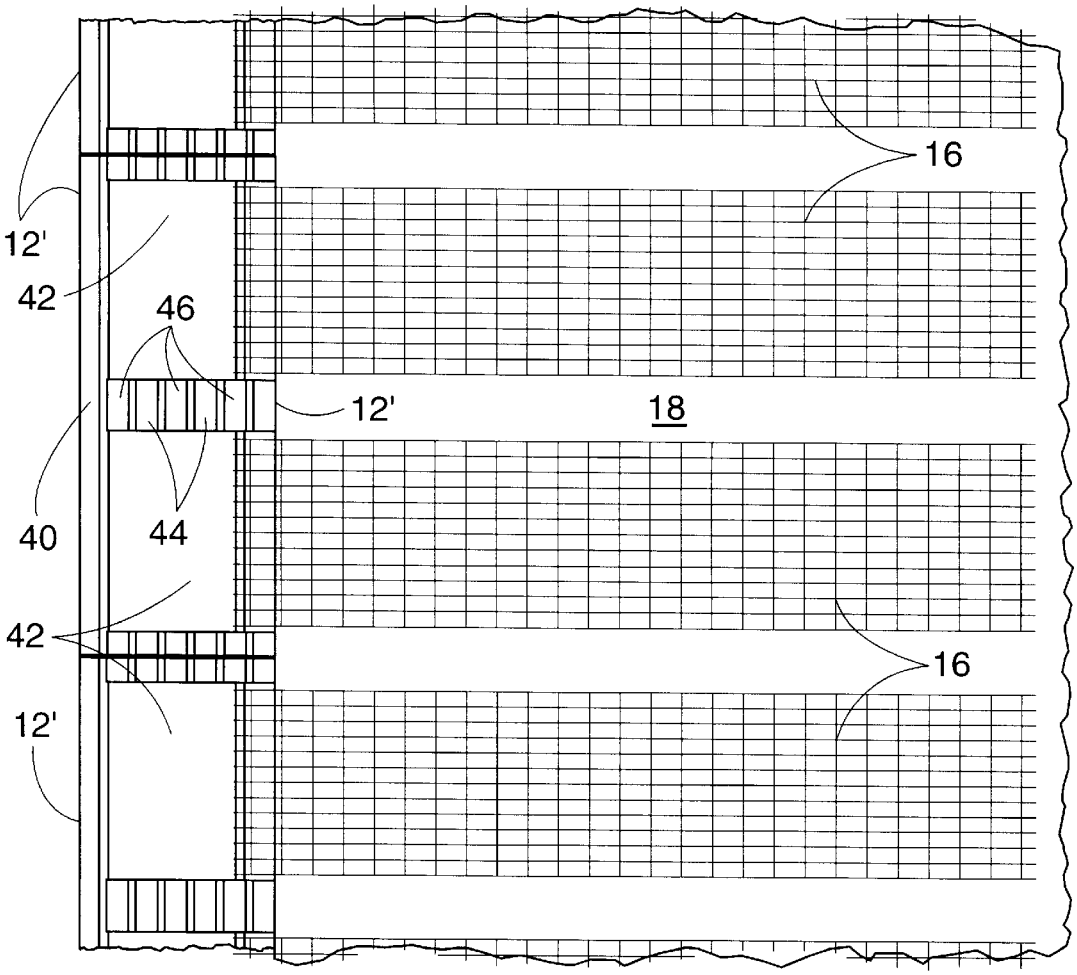
FIG. 5 is an enlarged cross-sectional top plan view taken substantially along line 5—5 of FIG. 2.

FIG. 5 is an enlarged, partial cross-sectional top plan view taken along line 5—5 of FIG. 2. Therein, the reinforcements 16 extend through the openings 42 in blocks 12' and thence backwardly into the soil bank 18.

Figure 6:
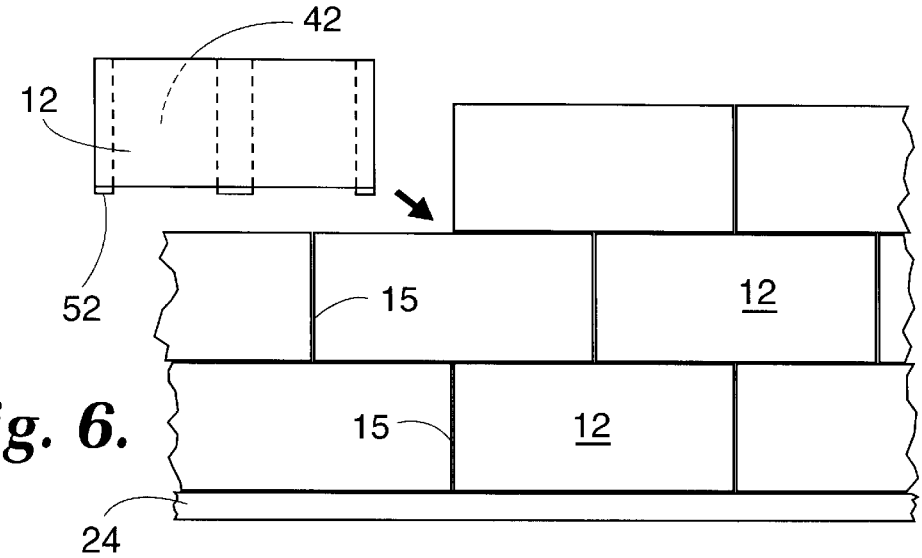
FIG. 6 is a front elevation depicting assembly of the concrete block facing elements of the invention, preferably in staggered, overlapping orientation as shown, i.e., one course of block oriented in staggered fashion with respect to an adjacent row of block.

FIG. 6 depicts in front elevation the assembly of block facing elements 12 in staggering or overlapping array, as shown, all stacked in rows upon foundation 24. It is preferable and important for drainage purposes and expected differential settlements that a space or gap 15 between adjacent blocks be maintained. A constant horizontal spacing of 10 mm between blocks is preferably maintained, and this may be achieved using spacers bonded to the sides of the blocks. To ensure long term drainage through the gaps 15 without washout therethrough of soil particles, strips of nonwoven geotextile material may also be affixed over these gaps before replacement of the backfill soil.

Method of Construction

A method of construction of retaining walls generally in accord with the present invention is described in my prior patents cited hereinabove, and those disclosures are incorporated herein as if set forth in full by reference thereto. The manufacturing procedures for masonry units according to the specifications herein are well known in the art.

Precast concrete blocks used as the wall facing elements 12 and 12' serve three purposes. They provide lateral support for the reinforced soil, anchor and protect the reinforcement at the front end, and render an aesthetically pleasing wall appearance. The proper combination of blocks makes it possible to construct gravity walls to significant heights without additional soil reinforcement. The maximum height of such a wall will depend on several factors such as the dimensions of the blocks, number of parallel blocks producing a row, properties of the backfill soil and the foundation soil, external forces, and the design earthquake intensity. Economics indicates that, typically, the maximum height of an unreinforced wall will be limited to about 3.5 m. Taller walls may be constructed with reinforced soil. Reinforcement materials to be employed include galvanized steel grids, geotextiles, geogrids, and other, similar, known reinforcements. The economics resulting from the natural soil terrain may dictate a combination of reinforcement materials. As described above, the stable wall system of the present invention is obtained by providing an integral, threaded connection between the reinforcement members employed and the facing blocks. This threaded connection allows for the reinforcement to transfer tensile loads due to lateral earth pressures backwardly into the stable soil. (Herein, "stable soil" means soil that is not supported by the fascia.) The reinforcement at the connection exerts only compressive stress into the rear wall of the concrete blocks.

The basic precast block unit is shown schematically in FIG. 3. Preferably, its external dimensions are 1200/600/580 mm, having walls 80 and 100 mm thick. The front face 40 of the block can be covered by decorative material such as slate 22, i.e. see FIG. 1. Bonding the covering to the block is done using mortar, and the covering is for aesthetic purposes only.

Referring again to FIG. 1, the elevation of the leveling pad 24 should be at least 30 cm below the final grade in front of the wall, or as otherwise specified by the design engineer. The leveling pad is made of cast-in-place concrete which can be poured directly against the sides of the excavated trench. FIG. 1 illustrates a typical leveling pad, omitting any reinforcements to tie together the pad 24 and the first row of blocks 12.

To construct the wall according to the invention, the following steps are preferably undertaken:

1. Excavate a ditch for the leveling pad 24 to a designed depth. The width of the ditch should be no less than the width of the first row of blocks. The top of the leveling pad should be at least 30 cm below the final grade of the soil in front of the wall, or as otherwise specified by the design engineer.
2. Pour concrete into the excavated ditch to form the leveling pad, preferably concrete with a minimum compressive strength of 200 kg/cm$^2$. Steel to reinforce the concrete may be used as specified.
3. Place the first row of blocks 12 over approximately a 3 cm layer of mortar (i.e., the mortar is inserted between the top of the leveling pad and the bottom of the blocks). To ensure drainage, a spacing of 10 mm may be provided between adjacent blocks (see FIG. 6).
4. Place layers of backfill soil and compact to specified density. Fill to the bottom indent of the row of blocks 12 (see FIG. 2).
5. Polymeric geogrid, available commercially from several manufacturers, meeting appropriate standards, may be employed. Polymeric or metallic reinforcement grids or sheets will be selected according to design specifications. The required strength of the reinforcement will be determined by the designer.
6. The reinforcements should be pre-cut or cut in the field having specified lengths and having widths to fit within the indents 50 of the blocks 12 and/or 12'. Place the layers of reinforcement so as to extend from the specified remote location behind the wall over the compacted soil and threaded into the first row of blocks, each reinforcement layer through its respective void of each corresponding block.
7. Place reinforced backfill soil in layers and compact to meet specifications; fill to the top indent 50 of the row of blocks, and position the threaded reinforcement layers backwardly over this compacted soil. The design may require concrete between stacked blocks to increase interblock shear resistance or to produce a rigid facing. Preferably the vertical distance between legs of the "U" formed by the reinforcement layers is approximately 20 cm., but again this must be according to design specifications.
8. Place another row of blocks, leaving 10 mm space between blocks for drainage.
9. Steps 4 through 8 are repeated until the desired wall height is attained.

In general, the length of the reinforcement material (steel grid or polymeric material), perpendicular to the wall face, should be uniform and sufficiently long to render a stable structure. British standards and American guidelines allow for shorter reinforcement lengths at the bottom ('Trapezoidal Wall'). It should be noted that while the invention enables the use of mixed reinforcements (i.e., a combination of steel grid and/or polymeric sheets or grids to provide a combination of 'extensible' and 'inextensible' reinforcements for the same wall), there is presently no known design method specifically addressing such a hybrid reinforcement system. However, such a combination of reinforcements can be used provided modified design calculations show that design requirements (for each type of reinforcement used) are met. The reinforced soil and its placement are critical factors in the long term performance of any wall. Accepted U.S. guidelines for such constructions must be followed.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A modular block masonry unit, having outside dimensions generally in the form of a parallelepiped, the masonry unit having six faces, including;

a front face and associated front wall of finite thickness, a top face, a bottom face, a rear face and associated rear wall of finite thickness, and two opposing side faces and side walls of finite thickness, said unit also having a center partition wall generally centrally oriented parallel to and between said two side walls and extending between said top and bottom faces, the masonry unit having voids extending within said unit and through the unit from the top face to the bottom face, each said void being bounded by one side wall, said front wall, said rear wall and said center partition wall, the rear wall having indents therein, four indents in all, adjacent both said top face and said bottom face, each indent extending within the rear wall from its associated side wall to said partition wall.

2. The masonry unit of claim 1 wherein said side walls and central partition wall are of the tongue-and-groove configuration, thereby facilitating vertical stacking and interlocking of a plurality of said masonry units.

* * * * *